United States Patent [19]

Harris

[11] Patent Number: 4,641,451

[45] Date of Patent: Feb. 10, 1987

[54] BIPOD MOUNTING DEVICE AND MUZZLE BRAKE

[76] Inventor: Gerald Harris, Rte. 1, P.O. Box 33, Barlow, Ky. 42024

[21] Appl. No.: 649,525

[22] Filed: Sep. 11, 1984

Related U.S. Application Data

[62] Division of Ser. No. 367,544, Apr. 12, 1982, Pat. No. 4,470,216.

[51] Int. Cl.[4] ..... F41C 29/00

[52] U.S. Cl. ..... 42/85; 42/94

[58] Field of Search ..... 42/1 V, 75 A, 75 B, 42/75 C, 75 D, 85, 1 A, 94; 89/37.04; 248/291; 403/98, 116, 167, 191, 234, 235, 236, 237

[56] References Cited

U.S. PATENT DOCUMENTS

| | | | |
|---|---|---|---|
| 861,939 | 7/1907 | Benet et al. | 89/33.01 |
| 965,158 | 7/1910 | Cowles | 248/291 |
| 1,029,951 | 6/1912 | Seely | 42/1 A |
| 1,372,599 | 3/1921 | Butler | 89/40.06 |
| 1,746,364 | 2/1930 | Schuler | 89/40.06 |
| 1,827,557 | 10/1931 | Bradford | 248/291 |
| 1,890,423 | 12/1932 | Teagarden | 42/94 |
| 2,375,721 | 5/1945 | Woodhull | 89/40.06 |
| 2,489,283 | 11/1949 | Garand | 42/94 |
| 2,845,737 | 8/1958 | Hoyer | 42/1 V |
| 2,933,843 | 4/1960 | McFeeter | 42/85 |
| 3,327,422 | 6/1967 | Harris | 42/94 |

FOREIGN PATENT DOCUMENTS

| | | | |
|---|---|---|---|
| 763020 | 4/1934 | France | 248/291 |
| 286537 | 10/1952 | Switzerland | 42/1 A |

OTHER PUBLICATIONS 1 page document—Harris Model 1A Bipods—Answers to Common Questions.

1 page document—Suggestions for Attachment and Use of Harris Bipod Models 1A-HR and 1A-LR.

*Primary Examiner*—Stephen C. Bentley

*Attorney, Agent, or Firm*—Harness, Dickey & Pierce

[57] ABSTRACT

An attachment or mounting apparatus is disclosed for securing a bipod or other auxiliary device to a variety of different types of firearms. In the preferred embodiment, the attachment or mounting apparatus incorporates a muzzle brake device therein. Various embodiments are disclosed wherein the longitudinal location, and the angle of attachment, of said bipod with respect to the firearm may be selectively adjusted by the user.

4 Claims, 12 Drawing Figures

BIPOD MOUNTING DEVICE AND MUZZLE BRAKE

This is a division of application Ser. No. 362,544, filed Apr. 12, 1982, now U.S. Pat. No. 4,470,216.

BACKGROUND AND SUMMARY OF THE INVENTION

The present invention relates to a bipod mounting device adapted for attachment to a firearm. More particularly, the preferred embodiment of the invention relates to such a bipod mounting device having a muzzle brake apparatus incorporated therein.

Modern firearms, such as rifles in particular, may be more accurately and conveniently fired by the user if the firearm is equipped with a bipod device for supporting the barrel. One example of a lightweight, detachable bipod device with foldable legs is described in my previous patent, U.S. Pat. No. 3,327,422, issued on June 27, 1967, the disclosure of which is incorporated by reference herein.

Said previous patent discloses a bipod device which is removably attached to the forearm portion of the stock of a firearm. Such attachment is preferably accomplished by means of a pair of link members having fingers or pins protruding therefrom which are received within an aperture extending laterally in a stud or other fastener member secured to the stock of the firearm. The stock of many firearms are provided with such apertured studs which are normally supporting a loop-shaped swivel member adapted to receive one end of a sling. The bipod device is secured against the forearm of the firearm by a threaded abutment screw which is extended to urge the base of the bipod device securely against the forearm of the firearm. While such bipod device of my earlier patent is well adapted for convenient use with many firearms whose stocks are equipped with the above-described stud or fastener member, other firearms frequently require modifications to provide the necessary stud or equivalent member having a head with an aperture therethrough for receiving the pins of the link members of the bipod device.

In accordance with the present invention, an alternative attachment or mounting apparatus is provided for securing a bipod device, such as that described in my earlier patent, to a variety of firearms which may not include an apertured stud or other fastener member such as that described above. In the preferred embodiment of the present invention, the attachment or mounting apparatus also incorporates a muzzle brake device therein. Such a muzzle brake device is a desirable addition to the barrel of a firearm for purposes of reducing recoil, muzzle jump and muzzle blast. Other alternate embodiments, both with and without muzzle brakes, are disclosed for adapting such a bipod device to a wide variety of firearms.

DETAILED DESCRIPTION OF THE PREFERRED EMBODIMENTS

Figure 1:
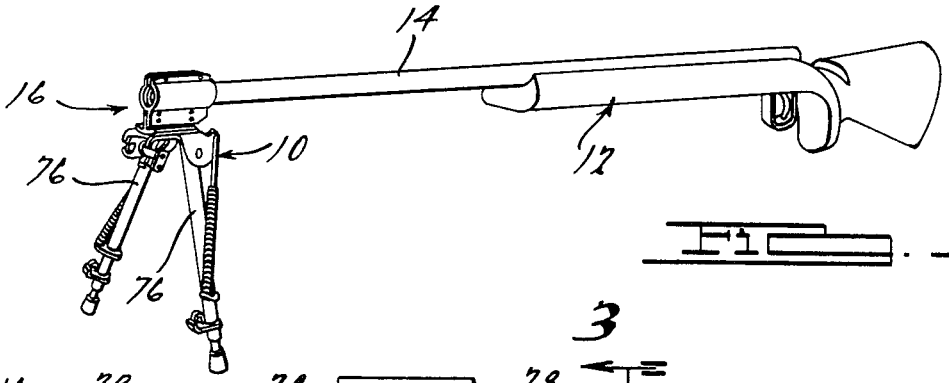
FIG. 1 is an overall perspective view of a rifle having a preferred embodiment of the bipod device and muzzle brake apparatus according to the present invention mounted thereon.

For purposes of illustration, various embodiments of the present invention are shown in the drawings as attached or mounted to a rifle. One skilled in the art will readily recognize, however, that various embodiments of the present invention are applicable to other types of firearms as well.

FIG. 1 generally illustrates a bipod device 10, similar to that described in the above-mentioned U.S. Pat. No. 3,327,422, mounted on a typical rifle 12. The bipod device 10 is secured to the barrel 14 of the rifle 12 by means of a preferred bipod mounting assembly 16, which includes a muzzle brake portion 18 therein. It should be noted that the mounting assemblies and apparatus shown in the drawings may be also employed for purposes of mounting or attaching auxiliary devices other than the bipod device 10.

Figure 2:
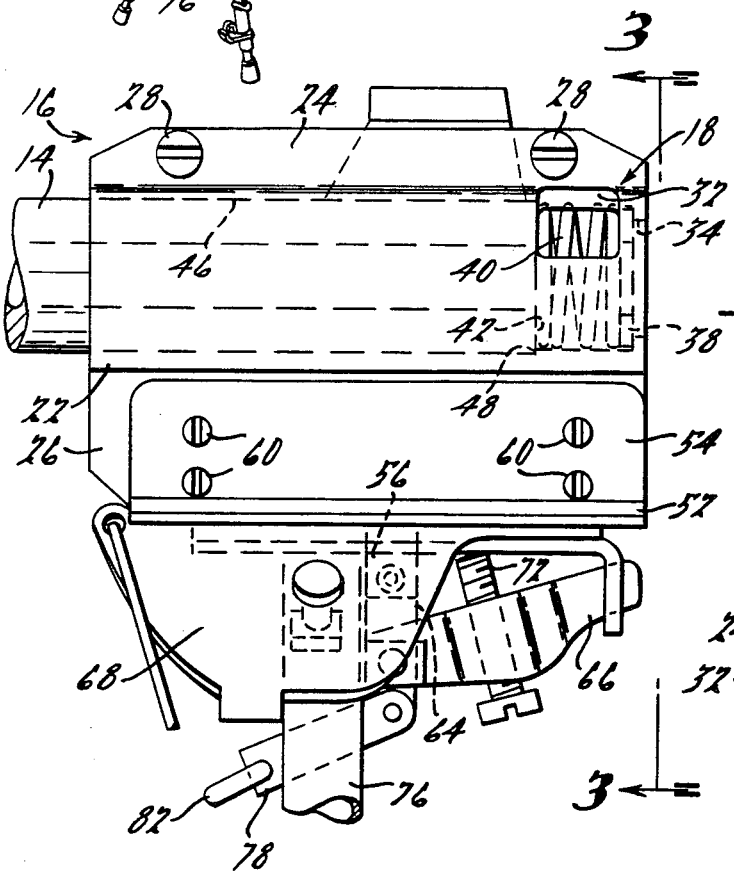
FIG. 2 is an enlarged detail view of the attachment or mounting assembly and muzzle brake apparatus of the preferred embodiment shown in FIG. 1.
Figure 3:
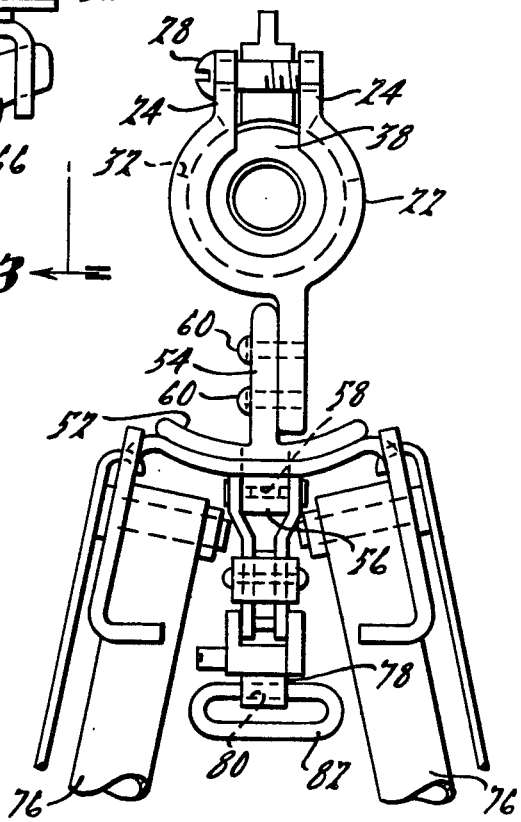
FIG. 3 is an end view taken along line 3—3 of FIG. 2.

As is best illustrated in FIGS. 2 and 3, the preferred bipod mounting assembly 16 includes a sleeve portion 22 with a pair of spaced upper flange members 24 protruding therefrom in a generally upward direction and a lower flange member downwardly depending therefrom. The sleeve portion 22 is split between the upper flange members 24 and is secured in a tight, clamping engagement or relationship with the periphery of the barrel 14 by one or more threaded fasteners 28 extending through corresponding apertures in the upper flange members 24.

As is mentioned above, the sleeve portion 22 of the preferred bipod mounting assembly 16 also includes a muzzle brake portion 18 therein. The muzzle brake portion 18 of the sleeve portion 22 preferably includes a pair of gas vent openings 32 extending generally in a radial direction therethrough. As is shown in FIG. 2, the muzzle brake portion 18 of the sleeve portion 22 extends longitudinally beyond the forward end 42 of the rifle barrel 14 and preferably includes an annular lip 34 at its outer end. A baffle ring 38 is biased in a generally outward direction in abutting engagement with the annular lip 34 by the force of a biasing spring 40 compressed between the baffle ring 38 and the forward end 42 of the rifle barrel 14. To ensure that the forward end 42 is properly spaced from the baffle ring 38 and that the proper biasing force is exerted upon the baffle ring 38 by the biasing spring 40, the inner bore 46 of the sleeve portion 22 is provided with a step 48 which abuttingly engages the outward end 42 of the rifle barrel 14.

The muzzle brake portion 18 of the preferred bipod mounting assembly 16 serves to lessen the effects of recoil, muzzle jump and muzzle blast upon firing a projectile from the rifle 12 by providing both the gas vent openings 32 and the baffle ring 38 against which the exhaust gases resulting from the firing of a cartridge can flow and impinge, respectively. As the gases escape from the end of the barrel 14, they exert a generally forward directed force on the baffle ring 38 and also flow in a generally upward or outward direction through the gas vent openings 32 to exert a force in a generally downward direction, thereby opposing and mitigating the recoil and muzzle jump forces. The baffle ring 38 is preferably composed of a relatively soft material, such as aluminum or brass for example, in order to prevent or minimize the damage in the event that an errant projectile contacts the baffle ring 38.

The preferred bipod mounting assembly 16 also includes a base portion or bipod mounting bracket 52 with an upwardly extending mounting flange or plate 54 and a downwardly extending mounting lug 56 thereon. A number of preferably threaded fasteners extend through a corresponding number of apertures in the mounting flange or plate 54 and serve to secure the mounting flange or plate 54 to the lower flange member 26 of the sleeve portion 22. Although not illustrated as such in the drawings, one or more of the apertures in the mounting flange or plate 54 may be in the form of an arcuate or kidney-shaped slot. Such a slot would allow the angle of attachment of the bipod mounting bracket 52 and thus the bipod device 10 to be adjusted merely by loosening the appropriate fasteners 60 and retightening them after adjusting the angle of the base portion or bipod mounting bracket 52 as desired. The mounting flange or plate 54 also includes a aperture 58 extending in a generally horizontal or lateral direction through the mounting lug 56 for receiving the fingers or pins 62 on the link members 64 of the bipod device 10.

As is described in my above-referenced previous patent, the link members 64 of the bipod device 10 are hingedly attached to a pivot member 66 which is pivotally mounted on a base member or platform 68 of the bipod device 10. An abutment screw 72 extends through a threaded aperture in the pivot member 66 to abuttingly engage the lower surface of the base member or platform 68. As the abutment screw 72 is threadably extended, the link members 64 and the mounting lug 56 are drawn or forcibly urged downwardly such that the bipod mounting bracket 52 of the bipod mounting assembly 16 is drawn into a tight abutting or clamping engagement with the base member or platform 68 to prepare the bipod device 10 for use. The legs 76 of the bipod device 10 may then be rotated to their lowered position, such as is shown in FIG. 1, to serve as a support mechanism for the barrel portion of the rifle 12.

The bipod mounting assembly also preferably includes a pivotally attached sling mounting lug 78 having an aperture 80 extending in a generally horizontal direction therethrough for receiving a loop-type sling swivel member 82. Such swivel member 82 allows a sling to be attached to the rifle 12 at roughly the same longitudinal location as the bipod device 10, thereby virtually eliminating any cumbersome interference between the folded legs of the bipod device and other paraphenalia when the rifle 12 is being carried by the user.

Figure 4:
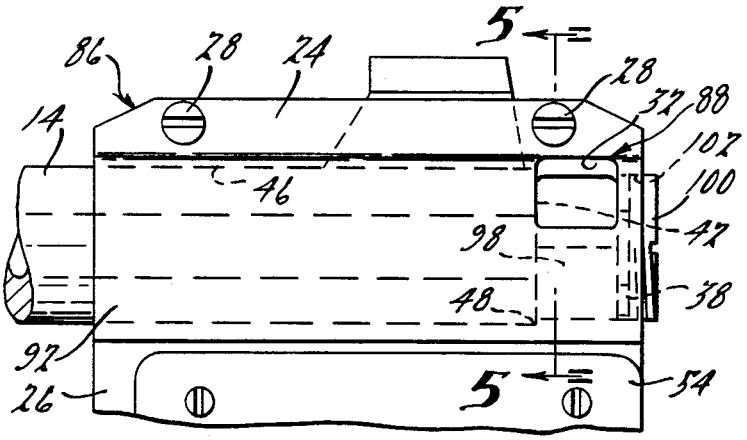
FIG. 4 is an elevation view of a bipod attachment or mounting apparatus similar to that of FIG. 2, but with an alternate muzzle brake apparatus included therein.
Figure 5:
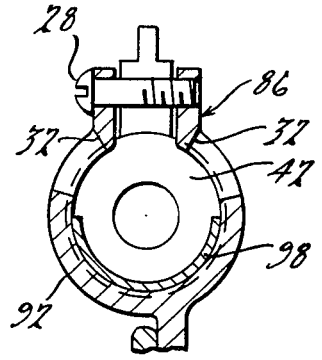
FIG. 5 is a cross-sectional view taken along line 5—5 of FIG. 4.

FIGS. 4 and 5 illustrate embodiment of the present invention wherein a bipod mounting assembly 86 preferably includes an alternate muzzle brake portion 88 thereon. The bipod mounting assembly 86 is similar to the above-described preferred bipod mounting assembly 16 in virtually all respects except for the configuration of the alternate muzzle brake portion 88.

The bipod mounting assembly 86 includes a sleeve portion 92 having an inner bore 96 extending longitudinally, and gas vent openings 32 extending radially, therethrough. A spacer member 98, which is preferably of a half-cylinder shape, is disposed within the lower half of the outer end of the inner bore 96 and serves to maintain a predetermined spacing between the outer end 42 of the rifle barrel 14 and the baffle ring 38 and to bias the baffle ring 38 against an externally threadable retainer ring 100. The baffle ring 38 is held in place at the outer end of the inner bore 96 by the externally threaded retainer ring 100 which threadably engages an internally threaded end portion 102 of the inner bore 96. As with the inner bore 46 of the preferred bipod mounting assembly 16, the inner bore 96 of the alternate bipod mounting assembly 86 includes a step 48 thereon for purposes of positioning the outward end 42 of the rifle barrel 14 at the proper longitudinal location with respect to the outer end of the sleeve portion 92.

It should be noted that the above-described annular lip 34 may alternatively be employed to retain the baffle ring 38 in place in the alternate muzzle brake portion 88 described herein. Similarly, the externally threaded retainer ring 100 shown in FIGS. 4 and 5 may alternatively be employed in the preferred muzzle brake porton 18 described above.

The alternate muzzle brake portion 88 of the bipod mounting assembly 86 functions in a manner similar to that of the muzzle brake portion 18 of the preferred bipod mounting assembly 16. As a cartridge is fired in the rifle 12, the exhaust gases exiting from the outward end 42 of the rifle barrel 14 impinge upon the baffle ring 38 and flow through the gas vent openings 32, thereby imposing forces thereon in generally forward and downward directions which tend to oppose and mitigate the effects of recoil and other forces. The baffle ring 38 in the alternate bipod mounting assembly 86 is also composed of a soft material, such as aluminum or brass for example, as is described above in connection with the preferred bipod assembly 16.

Figure 6:
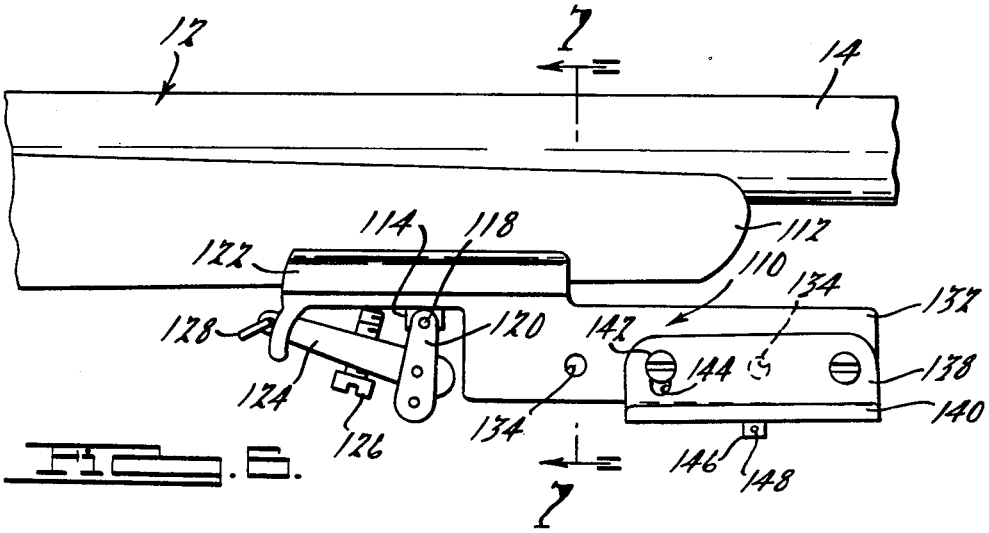
FIG. 6 is an elevation view of an alternate attachment or mounting apparatus for attaching a bipod device to the stock of a firearm, including means for selectively varying the longitudinal location and mounting angle of said bipod device.
Figure 7:
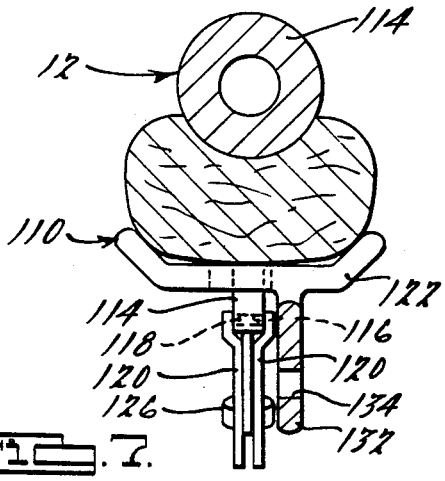
FIG. 7 is cross-sectional view taken along line 7—7 of FIG. 6.
Figure 8:
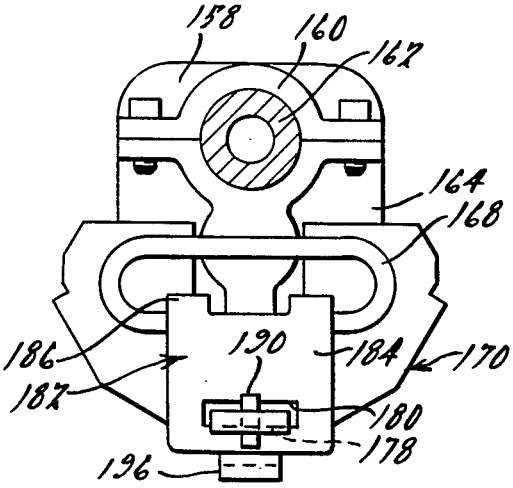
FIG. 8 is an alternate embodiment of still another attachment or mounting apparatus for attaching a bipod device to the stock of a firearm.
Figure 9:
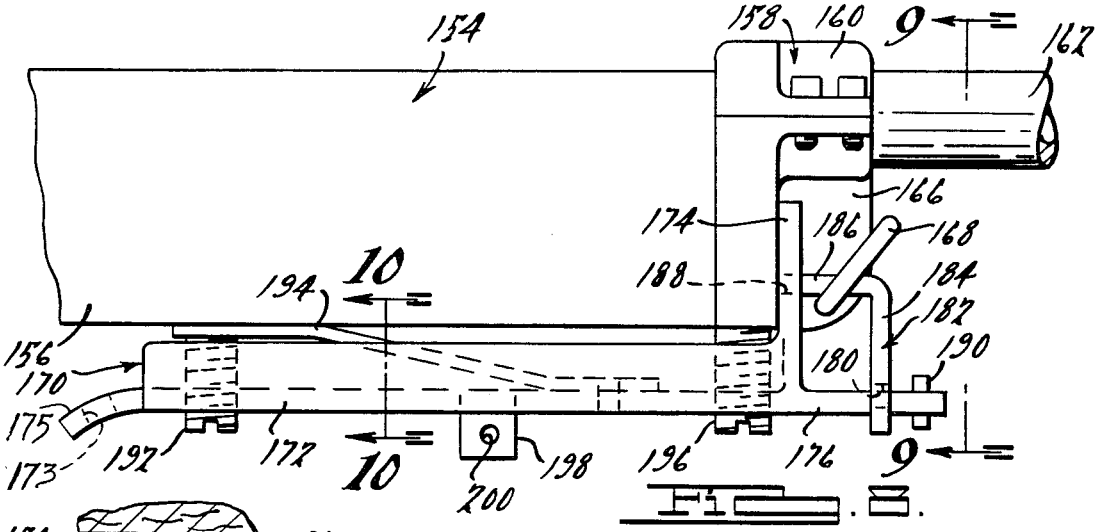
FIG. 9 is a cross-sectional view taken along line 9—9 of FIG. 8.
Figure 10:
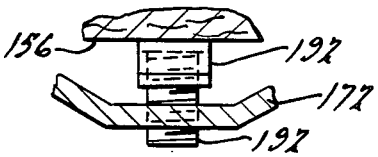
FIG. 10 is a cross-sectional view taken along line 10—10 of FIG. 8.

FIGS. 6 and 7 illustrate still another alternate embodiment of the invention, including a mounting bracket assembly 110 secured to the stock 112 of the rifle 12. The mounting bracket assembly 110, shown for purposes of illustration in FIG. 10, does not include a muzzle brake device therein. One skilled in the art, however, will readily recognize that many of the principles of the embodiment of FIGS. 6 and 7 are equally applicable to barrel-mounted attachment devices with muzzle brakes incorporated therein such as those shown in the other embodiments described herein. Secured to the stock 112 of the rifle 12 is a stud or other fastener member 114 with an aperture 116 extending in a generally horizontal or lateral direction therethrough. The aperture 116 is adapted for receiving a pair of fingers or pins 118 on the link members 120 of the mounting bracket assembly 110. Similar to the bipod device 10, described above and in my above-referenced previous 158, respectively. The combination of such forces creates a mechanical couple which serves to clamp the attachment bracket 170 securely to the rifle 154.

Once the attachment bracket 170 is secured to the rifle 154, the bipod device 10 (not shown) may be attached thereto by means of the fingers or pins 62 of the link members 64 being received within the aperture 200 of the mounting lug 198, as is fully described above in connection with other embodiments of the invention.

It should be noted that a small degree of adjustment of the angle of attachment of the bipod device 10 to the firearm 154 may be obtained by further tightening or extending the abutment screw 192 and thereby increasing the angle between the attachment bracket 170 and the stock 156.

Figure 11:
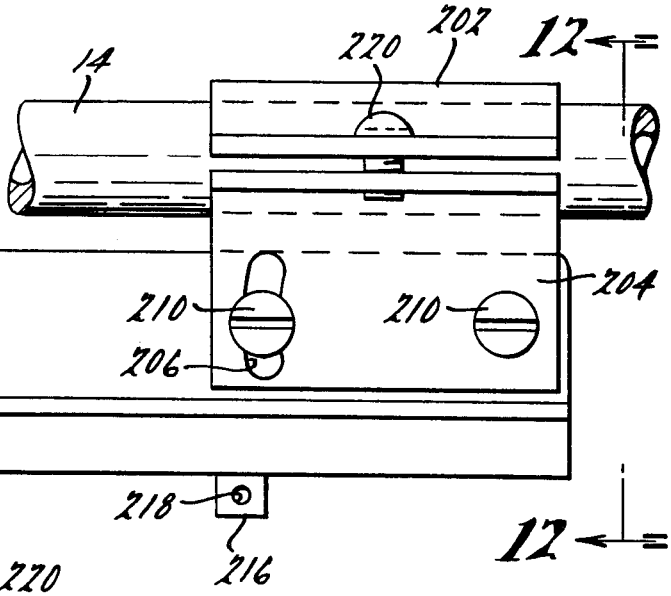
FIG. 11 is an elevation view of a further alternate attachment or mounting apparatus for attaching a bipod device to the barrel of a firearm.
Figure 12:
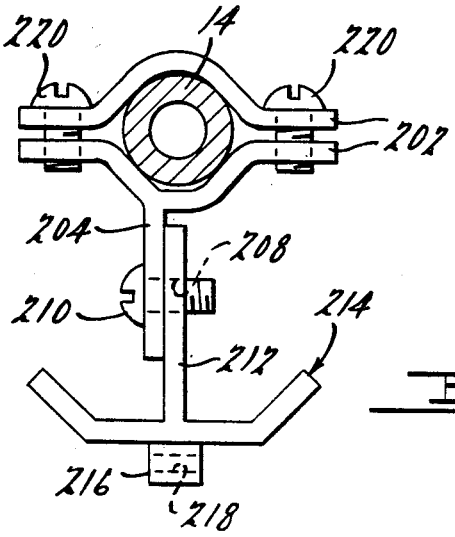
FIG. 12 is a cross-sectional view taken along line 12—12 of FIG. 11.

FIGS. 11 and 12 illustrate still another embodiment of the present invention for mounting the above-described bipod device 10 ( not shown) onto the barrel 14 of a firearm. Although the embodiment of FIGS. 11 and 12 is shown in the drawings, for purposes of illustration, with no muzzle brake apparatus included therein, one skilled in the art will readily recognize from the foregoing description of other embodiments of the invention that the embodiment of FIGS. 11 and 12 may be modified to include such muzzle brake apparatus.

A split sleeve portion 202 surrounds and tightly engages the barrel 14 of a rifle in a clamping engagement therewith and includes a mounting flange member 204 downardly depending therefrom. A pair of apertures 206 and 208 extend horizontally or laterally through the flange member 204 for receiving corresponding fasteners 210 by which the flange member 204 may be secured to the mounting plate 212 of the base portion or bipod mounting bracket 214. Preferably, at least one of the apertures in the flange member 204 is formed in an arcuate or kidney-shaped configuration such that the angle of attachment of the bipod mounting bracket 214 and thus the bipod device 10 may be varied according to the desires of the user.

The bipod mounting bracket 214 includes a mounting lug 216 which protrudes from its lower surface and has an aperture 218 extending horizontally or laterally therethrough.

The bipod device 10 is attached or secured to the bipod or mounting bracket 214 by means of the fingers or pins 62 of the link members 64 of the bipod device 10 as is described fully above in connection with other embodiments of the invention. Since the upper and lower members of the split sleeve portion 202 are secured together by a pair of threaded fasteners 220, the longitudinal location of the bipod device 10 (not shown) may be altered at will by the user merely by loosening the fasteners 220 and sliding the split sleeve portion 202 to the desired location. Furthermore, in the event that the mounting plate 212 interferes with other portions of the rifle, the split sleeve portion 202 may be mounted in an orientation opposite to that shown in FIG. 11, whereby the mounting plate 212 protrudes in a forward rather than a rearward direction.

It can be readily seen by one skilled in the art that the various embodiments depicted in the drawings and described above are well suited to adapt the above-described bipod device of my earlier patent to a wide variety of firearms. Furthermore, in most applications, the advantages of a muzzle brake apparatus may be obtained by employing the preferred embodiments of the inventions as described above.

The foregoing description and accompanying drawings illustrate merely exemplary embodiments of the present invention. Various changes, modifications and variations may be made therein without departing from the spirit and scope of the invention as defined in the following claims.

I claim:

1. An apparatus for attaching a bipod to a firearm, said apparatus comprising:

a base having a mounting plate, a mounting bracket on the bottom edge of said mounting plate extending generally transversely thereto, and a mounting lug extending downwardly from said mounting bracket, said mounting bracket and mounting plate being generally inverted T-shaped in cross section with said mounting bracket having upturned lateral edge portions;

mounting means for attaching said base to a firearm, said mounting means having a mounting flange longitudinally angularly adjustably attached to said mounting plate, said mounting plate and said mounting flange being in parallel engaging relationship and selectively adjustably attached to each other by means of a pair of fasteners, one of said pair of fasteners extending through an arcuate aperture in one of said mounting plate and said mounting flange, said arcuate aperture being positioned to allow longitudinally angular adjustment of said mounting plate with respect to said mounting flange, said mounting flange extending from a split sleeve portion of said means for attaching said base to a firearm, said split sleeve portion having a longitudinal inner bore for clampingly receiving a barrel of a firearm and said split sleeve portion exerting clamping force in a direction substantially parallel to the plane of said mounting flange.

2. An apparatus for attaching a bipod to a firearm, said apparatus comprising:

a base having a mounting plate, a mounting bracket on the botton edge of said mounting plate extending generally transversely thereto, and a mounting lug, said mounting bracket having upturned lateral edge portions and said mounting lug extending downwardly from said mounting bracket; and mounting means for attaching said base to a firearm said mounting means comprising a split sleeve portion with a longitudinal inner bore extending therethrough sized for clampingly engaging a barrel of a firearm, said split sleeve portion having a mounting flange extending downwardly therefrom, said mounting flange being longitudinally angularly adjustably attached to said mounting plate; said mounting plate and said mounting flange being in parallel engaging relationship and selectively adjustably attached to each other by means of a pair of fasteners, one of said pair of fasteners extending through an arcuate aperture in one of said mounting plate and mounting flange, said arcuate aperture being positioned to allow longitudinally angular adjustment of said mounting plate with respect to said mounting flange.

3. An apparatus as in claim 2 wherein said split sleeve exerts clamping force in a direction substantially parallel to the plane of said mounting flange.

4. An apparatus as in claim 3 wherein said base is generally T-shaped in inverted cross-section.

* * * * *